United States Patent [19]

Ishikawa et al.

[11] Patent Number: 4,791,902

[45] Date of Patent: Dec. 20, 1988

[54] THROTTLE VALVE CONTROL SYSTEM FOR AN INTERNAL COMBUSTION ENGINE

[75] Inventors: Yoshikazu Ishikawa; Kouji Yamaguchi, both of Wako, Japan

[73] Assignee: Honda Giken Kogyo Kabushiki Kaisha, Tokyo, Japan

[21] Appl. No.: 73,655

[22] Filed: Jul. 15, 1987

[30] Foreign Application Priority Data

Jul. 16, 1986 [JP] Japan ..... 61-168844
Jul. 16, 1986 [JP] Japan ..... 61-168846
Jul. 16, 1986 [JP] Japan ..... 61-168849

[51] Int. Cl.[4] ..... F02D 9/08; F02D 41/14
[52] U.S. Cl. ..... 123/399; 123/361
[58] Field of Search ..... 123/339, 352, 399, 361

[56] References Cited

U.S. PATENT DOCUMENTS 4,625,690 12/1986 Morita ..... 123/399 X

FOREIGN PATENT DOCUMENTS 192843 10/1985 Japan .

*Primary Examiner*—Tony M. Argenbright
*Attorney, Agent, or Firm*—Pollock, Vande Sande and Priddy

[57] ABSTRACT

A throttle valve control system for an internal combustion engine sets a target value of a pressure in an intake pipe of the engine for attaining a minimum fuel consumption rate in response to a detected engine rotational speed, and drives the throttle valve to an opening determined so as to reduce the difference between the detected actual pressure in the intake pipe and the target value of the pressure in the intake pipe. When the actual operation position of the throttle valve is not in an allowable range of a target throttle valve opening determined in response to the detected engine speed, the throttle valve is controlled to reduce the difference between the actual operation position of the throttle valve and the target throttle valve opening.

6 Claims, 8 Drawing Sheets

THROTTLE VALVE CONTROL SYSTEM FOR AN INTERNAL COMBUSTION ENGINE

BACKGROUND OF THE INVENTION

1. Field of the Invention

The present invention relates to a throttle valve control system for controlling the opening of the throttle valve of an internal combustion engine.

2. Description of Background Information

Various measures have been proposed for improving fuel economy of an internal combustion engine. The lean burn system characterized by the supply of a lean air-fuel mixture, the generation of swirling action in the combustion chamber for enhancing sufficient mixture flow in the combustion chamber, or the improvement of the shape of the combustion chamber, are examples of such measures. However, in those systems, there has been a problem that the structure of the system generally becomes complicated, so that an increase of the cost is not avoided. One method for solving the above problem is to provide a system for controlling the opening of the throttle valve of the engine. For example, Japanese Patent Application Laid Open No. P60-192843 discloses a control of the throttle valve opening in which the throttle valve opening is determined simply ,in accordance with the operation position of the accelerator pedal and the engine rotational speed. Therefore, the improvement of the fuel economy was not gained by such a throttle valve opening control.

Furthermore, with a vehicle equipped with a system for controlling the engine rotational speed in accordance with the operating position of the accelerator pedal such as the CVT (continuously variable transmission), the engine rotational speed does not rise rapidly due to a delay of response of the system to the control operation even if the throttle valve is depressed rapidly for accelerating the vehicle. In the case of an arrangement in which the throttle valve opening is always controlled to a target throttle opening determined correspondingly to the engine speed, the throttle valve opening can not be increased rapidly, making it impossible to secure good acceleration of the vehicle. Therefore, it is desirable to devise a suitable measure for preventing such a problem.

On the other hand, in a region in which the throttle valve opening is small, the amount of engine intake air varies widely with respect to a smaller change in the throttle valve position than in a state in which the throttle valve opening is medium or high. Therefore, if the throttle valve is controlled indirectly, for example by using a motor all the time, a problem may arise that the driveability of the engine becomes unsatisfactory with respect to delicate operations of the accelerator pedal by the driver. Moreover, hunting of the throttle opening with respect to a control throttle valve opening due to a delay of response to the control operation, makes it difficult to maintain a good driveability of the engine. Therefore, it is desirable to provide a suitable measure for preventing this problem.

OBJECTS AND SUMMARY OF THE INVENTION

An object of the present invention is therefore to provide a throttle valve control system for an internal combustion engine which has a simple structure and which can be made at relatively low cost, while enabling sufficient improvement of fuel economy.

Another object of the present invention is to provide a throttle valve control system for an internal combustion engine by which fuel economy is improved while maintaining the acceleration of the engine under a condition in which the accelerator pedal is depressed rapidly.

A further object of the present invention is to provide a throttle valve control system for an internal combustion engine which can improve the fuel economy of the engine while maintaining the driveability of the engine in a region of small throttle valve opening.

According to the present invention, the throttle valve control system is operative to set a target throttle valve opening at which the minimum fuel consumption rate is attained correspondingly to a detected engine speed, a target pressure in the intake pipe (referred to as intake manifold pressure hereinafter) at which the minimum fuel consumption rate is attained correspondingly to the detected engine speed, to drive the throttle valve so as to reduce a difference between the target intake manifold pressure and a detected actual intake manifold pressure when the detected actual throttle valve opening is in an allowable range of the target throttle valve opening, and to drive the throttle valve so as to reduce the difference between the actual throttle valve opening and the target throttle valve opening when the detected actual throttle valve opening is outside of the allowable range of the target throttle valve opening.

According to another aspect of the present invention, the throttle valve control system is operative to drive the throttle valve to an opening angle corresponding to a detected rate of change in the operation position of the throttle valve when the speed of the change in the detected operation position of the accelerator pedal is greater than a predetermined value, and subsequently to control gradually the throttle valve to the target throttle valve opening.

According to a further aspect of the present invention, the throttle valve control system is operative to set a target value of a selected parameter of engine operation at which the minimum fuel consumption rate is attained, correspondingly to the detected actual engine rotational speed, to drive the throttle valve to an opening which is proportional to an actual operation position of an accelerator pedal when the actual operation position of the accelerator pedal does not reach a predetermined position, and to drive the throttle valve so as to reduce the difference between the set target value and a detected value of the selected parameter of the engine operation when the actual operation position of the accelerator pedal is beyond the predetermined position.

DETAILED DESCRIPTION OF PREFERRED EMBODIMENTS

The preferred embodiments of the present invention will be described with reference to the accompanying drawings.

Figure 1:
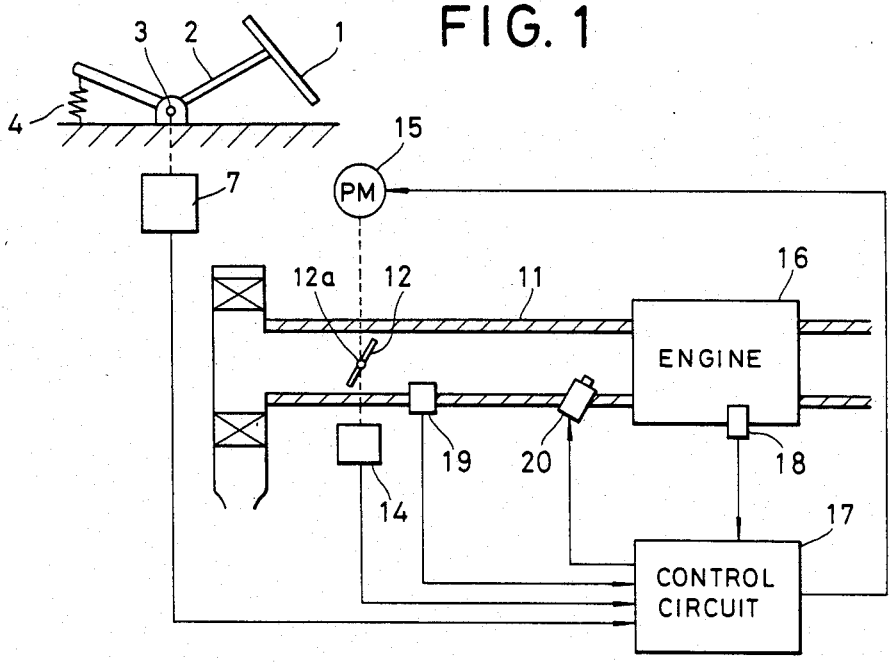
FIG. 1 is a schematic diagram of the construction of embodiments of the present invention.

In the throttle valve control system shown in FIG. 1 as the preferred embodiment of the present invention, an accelerator pedal 1 is connected at an end of a bracket 2, having a generally doglegged shape, which is supported on a shaft 3 so that a swing motion of the accelerator pedal 1 with respect to the floor of the vehicle is permitted. At the other end of the bracket 2, there is provided a return spring 4 for urging the accelerator pedal 1 toward an idling position. An accelerator pedal operation position sensor 7 made up of a potentiometer is connected to the shaft 3, and produces an output voltage corresponding to the accelerator pedal angle, i.e., the rotation angle of the accelerator pedal around the shaft 3 from the idle position.

On the other hand, a throttle valve 12 is provided in an intake pipe 11 of the engine and a shaft 12*a* of the throttle valve 12 is provided with a throttle valve opening sensor 14 which is made up of a potentiomater like the acceleration pedal operation position sensor 7. The throttle valve opening sensor 14 generates an output voltage corresponding to an opening angle of the throttle valve 12. In addition, a rotation shaft of a pulse motor 15 is connected to the shaft 12*a* of the throttle valve 12.

The accelerator pedal operation position sensor 7, the throttle valve opening sensor 14, and the pulse motor 15 are connected to a control circuit 17. To the control circuit 17 are also connected a crank angle sensor 18 which generates a pulse signal at a predetermined angular position of a crankshaft of the engine (not shown) with the rotation of the crankshaft, an absolute pressure sensor 19 for generating an output signal which represents an absolute intake manifold pressure, and an injector 20 for injecting the fuel into the engine.

Figure 2:
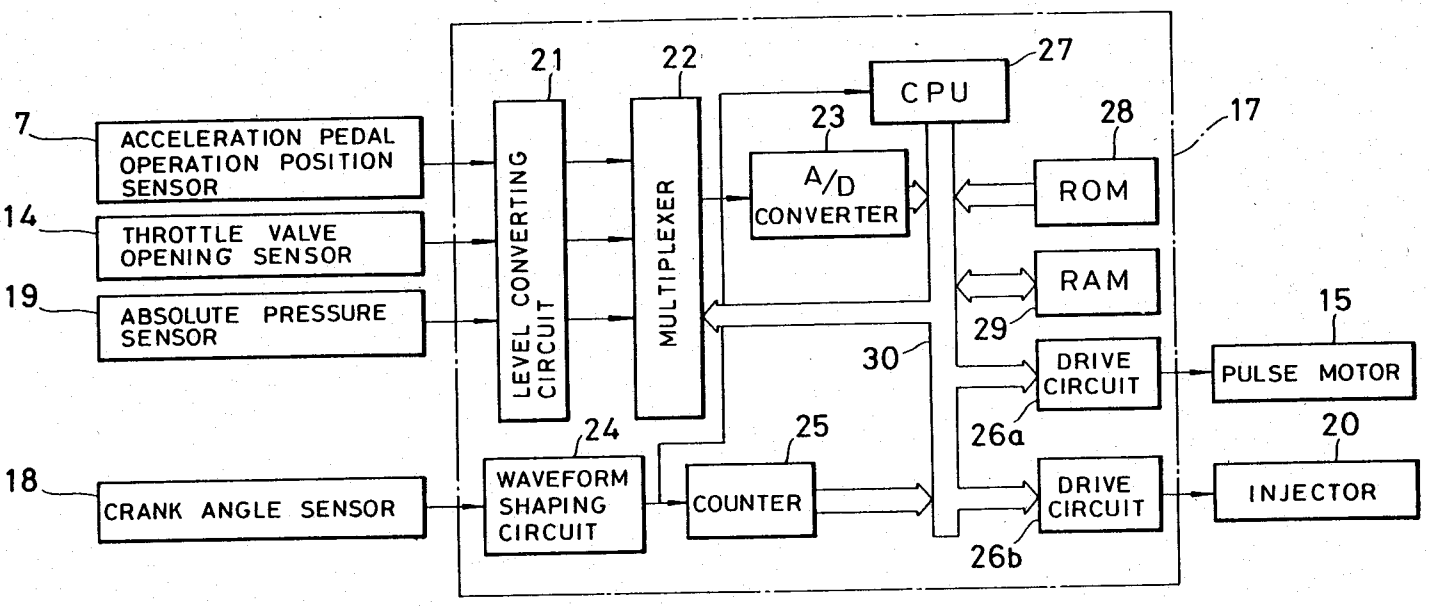
FIG. 2 is a block diagram showing a concrete construction of the control circuit in the system shown in FIG. 1.

The control circuit 17 is, as shown in FIG. 2, made up of a level converting circuit 21 for the level conversion of respective output signals of the pedal operating position sensor 7, the throttle valve opening sensor 14, and the absolute pressure sensor 19, a multiplexer 22 for selectively transmitting one of the voltage signals supplied through the level converting circuit 21, an A/D converter 23 for performing an analog to digital conversion of an output signal of the multiplexer 22, a waveform shaping circuit 24 for the waveform shaping of the output signal of the crank angle sensor 18, a counter for measuring the interval of generation of TDC signals which are produced as the pulse signals generated by the waveform shaping circuit 24, by counting clock pulses supplied from a clock pulse generating circuit (not shown), a drive circuit 26*a* for driving the pulse motor 15, a drive circuit 26*b* for driving the injector 20, a CPU (central processing unit) 27 for performing digital operations in accordance with programs, a ROM 28 in which programs and data are stored previously, and a RAM 29. The multiplexer 22, the A/D converter 23, the counter 25, the drive circuits 26*a* and 26*b*, the CPU 27, the ROM 28, and the RAM 29 are mutually connected by means of a bus 30. Furthermore, a clock pulse signal is supplied to the CPU 27 from a clock pulse signal generating circuit which is not illustrated. The CPU 27 operates as first and second setting means, and the CPU 27 and the drive circuit 26*a* operate as throttle valve driving means.

With this structure, information of the accelerator pedal angle $\theta_{ACC}$, the throttle valve opening angle $\theta$th, and the absolute intake manifold pressure $P_{BA}$ selectively from the A/D converter 23 as well as information of the engine rotational speed Ne from the counter 25, is supplied to the CPU 27 through the bus 30. The CPU 27 reads the above information according to the operation program stored in the ROM 28 and in synchronism with the clock pulses.

By the processing operation which will be explained later, the CPU 27 generates a pulse motor valve open drive command and a pulse motor valve close drive command for driving the pulse motor 15, and a pulse motor drive stop command for stopping the drive of the pulse motor 15 and supplies them selectively to the drive circuit 26*a*.

Figure 3:
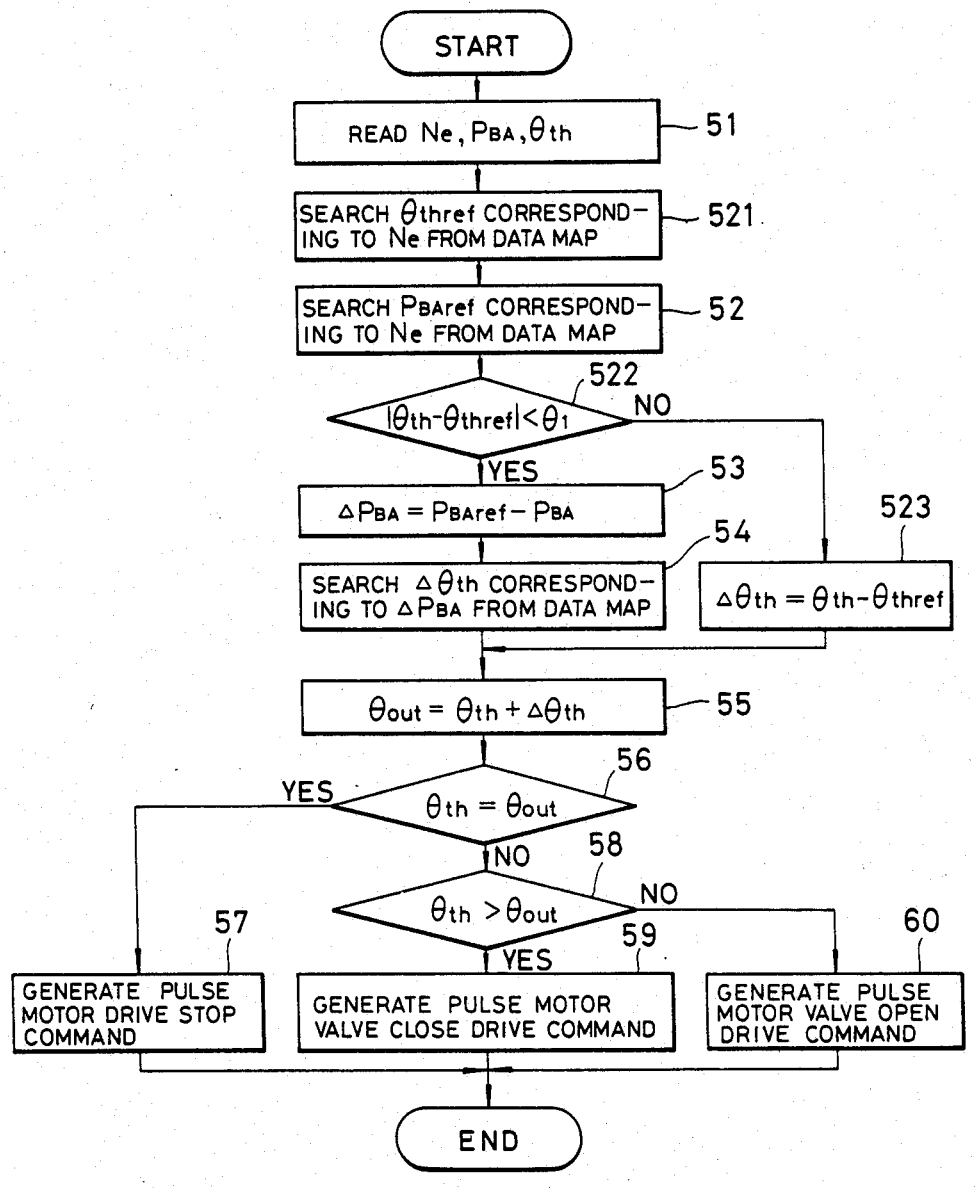
FIG. 3 is a flowchart showing the operation of the CPU 27 in a first embodiment of the present invention.

The operation of a first embodiment of a throttle valve control system having the above construction according to the present invention will be explained with reference to the operation flowchart of the CPU 27 shown in FIG. 3.

Figure 4:
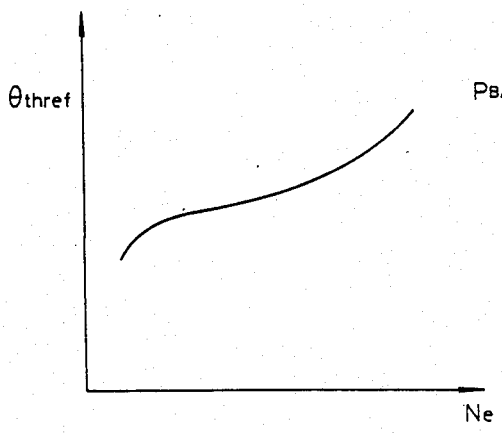
FIG. 4 is a diagram showing the characteristic of a $\theta$thref data map which is previously stored in the ROM 28.
Figure 5:
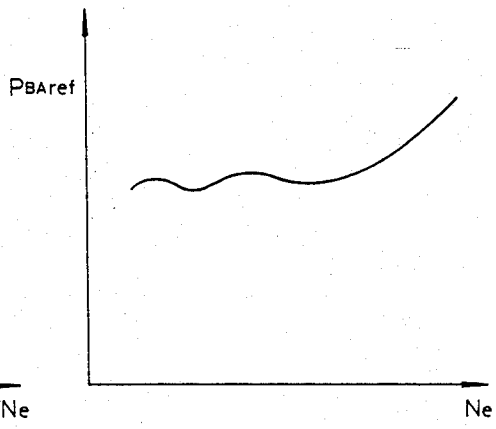
FIG. 5 is a diagram showing the characteristic of a $P_{BAref}$ data map which is previously stored in the ROM 28.
Figure 6:
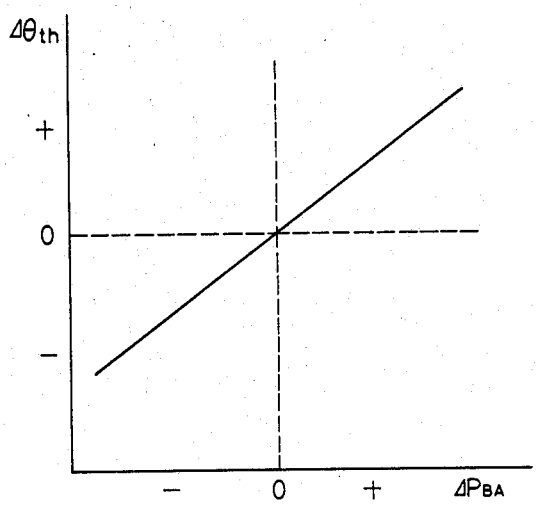
FIG. 6 is a diagram showing the characteristic of a $\Delta\theta$th data map which is previously stored in the ROM 28.

At predetermined intervals, the CPU 27 reads the engine rotational speed Ne, the absolute intake manifold pressure $P_{BA}$ and the throttle valve opening $\theta$th at a step 51. A target throttle opening $\theta$thref corresponding to the read value of the engine rotational speed Ne is searched at a step 521. In the ROM 28, various values of the target throttle opening $\theta$thref at which a minimum fuel consumption rate is attained, are previously stored correspondingly to the engine rotational speed value in the form of a $\theta$thref data map, as shown by the characteristic curve of FIG. 4. Therefore, the CPU 27 searches a value of the target throttle opening $\theta$thref corresponding to the read value of the engine rotational speed Ne from the $\theta$thref data map. Then, a target absolute intake manifold pressure $P_{BAref}$ corresponding to the read value of the engine rotational speed Ne is searched from a $P_{BAref}$ data map which is previously stored in the ROM 28 and having a characteristic as shown in FIG. 5, at a step 52. Subsequently, at a step 522, whether or not the absolute value of a difference between the read value of the actual throttle valve opening $\theta$th and the target throttle valve opening $\theta$thref is smaller than a predetermined allowable value $\theta_1$ is detected. If $|\theta th-\theta thref| < \theta_1$, the CPU 27 calculates a difference $\Delta P_{BA}$ between the target intake manifold pressure $P_{BAref}$ and the read value of the absolute intake manifold pressure $P_{BA}$ at a step 53. Subsequently, at a step 54, the CPU 27 searches a correction amount $\Delta\ \theta th$ of the opening of the throttle valve 12 corresponding to the difference $\Delta\ P_{BA}$ from a $\Delta\ \theta th$ data map which is previously stored in the ROM 28 as shown by the characteristic curve of FIG. 6.

On the other hand if $|\theta th-\theta thref| \geqq \theta_1$, a difference obtained by subtracting the target throttle valve opening $\theta thref$ from the actual throttle valve opening $\theta th$ is made as the correction amount $\Delta\ \theta th$ at a step 523. Then, the read value of the throttle valve opening $\theta th$ and the correction amount of the opening $\Delta\ \theta th$ are added together to generate a control throttle valve opening $\theta out$ at a step 55. Then whether or not the read value of the throttle valve opening $\theta th$ is equal to the control throttle valve opening $\theta out$ is detected at a step 56. If $\theta th=\theta out$, the pulse motor drive stop command is generated and supplied to the drive circuit 26a at a step 57. If, on the other hand, $\theta th \neq \theta out$, whether or not the throttle valve opening $\theta th$ is greater than the control throttle valve opening $\theta out$ is detected at a step 58. If $\theta th > \theta out$, the pulse motor valve close drive command is generated and supplied to the drive circuit 26a at a step 59 so as to move the throttle valve in the closing direction. If $\theta th > \theta out$ is not satisfied, i.e., if $\theta th \leqq \theta out$, the pulse motor valve open drive command is generated and supplied to the drive circuit 26a at a step 60 so as to drive the throttle valve 12 in the opening direction.

The drive circuit 26a drives the pulse motor 15 in the forward direction in response to the pulse motor valve open drive command, to move the throttle valve 12 in the opening direction. In response to the pulse motor valve close drive command, the drive circuit 26a drives the pulse motor 15 in the reverse direction, to move the throttle valve 12 in the closing direction. Furthermore, in response to the pulse motor drive stop command, the drive circuit 26a stops the drive of the pulse motor 15, to maintain the opening of the throttle valve 12 at that moment By these operations, the opening angle $\theta th$ of the throttle valve is controlled so that it follows the control throttle valve opening $\theta out$.

The above explained operation is summarized as follows. That is, if $|\theta th-\theta thref \geqq \theta_1$, the actual throttle valve opening is deviated greatly from the target throttle valve opening $\theta thref$ at which the minimum fuel consumption rate is attained. Therefore, in order to control the absolute intake manifold pressure $P_{BA}$ to become equal to the target absolute intake manifold pressure $P_{BAref}$, it is necessary to control the throttle valve in a control cycle which is slower than a time period required for changing the absolute intake manifold pressure, thus limiting the response characteristic of the system. Therefore, under this condition, the throttle valve is driven with the difference $\theta th-\theta thref$ being used as the opening correction amount $\Delta\ \theta th$ so that the throttle valve opening rapidly approaches the target throttle valve opening $\theta thref$. On the other hand, if $|\theta th-\theta thref| < \theta_1$, it means that the actual throttle valve opening $\theta th$ is in an allowable range of the target throttle valve opening $\theta thref$ at which the minimum fuel consumption rate is attained. Therefore, the throttle valve is controlled under this condition, so that the absolute intake manifold pressure $P_{BA}$ becomes equal to the target absolute intake manifold pressure $P_{BAref}$. This is because a relatively good follow-up characteristic toward the target absolute intake manifold pressure is maintained even if the throttle valve is controlled in the slow control cycle.

In the above explained embodiment of the present invention, the opening correction value $\Delta\ \theta th$ is determined by using the $\Delta\ \theta th$ data map. However, this is not limitative and the opening correction value $\Delta\ \theta th$ can be derived by using a calculation formular such as $\Delta\ \theta th = k_1 \cdot \Delta P_{BA}$ ($k_1$, being a constant).

Again, in the above explained first embodiment of the throttle valve control system for an internal combustion engine, the throttle valve is driven to reduce the difference between the actual intake manifold pressure and the set value of the target intake manifold pressure at which the minimum fuel consumption rate is attained when the actual throttle valve opening is in an allowable range of the target throttle valve opening at which the minimum fuel consumption rate is attained. When the actual throttle valve opening is outside of the allowable range of the target throttle valve opening, the throttle valve is driven to reduce the difference between the actual throttle valve opening and the target throttle valve opening. Thus, the fuel economy of the engine is improved with a construction of relatively low cost, and also the delay of the control operation is prevented to improve the response characteristic of the system.

Figure 7:
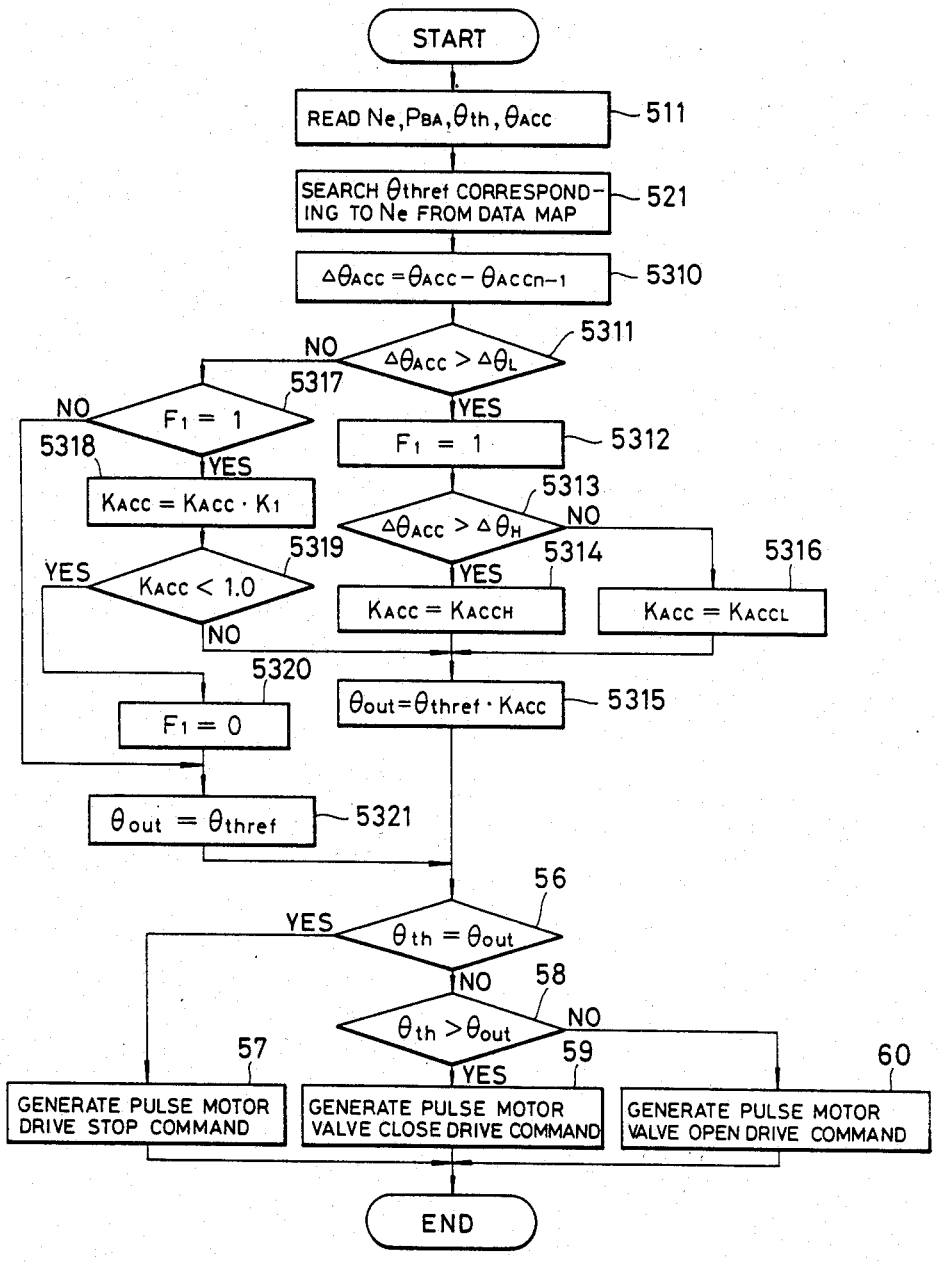
FIG. 7 is a flowchart showing the operation of the CPU 27 in a second embodiment of the present invention.

Referring to the flowchart of FIG. 7, the operation of the second embodiment of the throttle valve control system according to the present invention will be explained.

As in the previous embodiment, the CPU 27 reads the engine rotational speed Ne, the absolute pressure manifold pressure $P_{BA}$, the throttle valve opening $\theta th$ and the accelerator pedal angle $\theta_{ACC}$ at predetermined intervals at the step 511. In accordance with the read value of the engine rotational speed Ne, the CPU 27 searches, at the step 521, the target throttle valve opening $\theta thref$ corresponding to the read value of the engine rotational speed Ne from the $\theta thref$ data map having the characteristic shown in FIG. 4. Then, the CPU 27 calculates, at a step 5310, an amount of change $\Delta\ \theta_{ACC}$ between the accelerator pedal angle $\theta_{ACC}$ read this time and the accelerator pedal angle $\theta_{ACCN-1}$ read at a previous time. Then whether or not the amount of change $\Delta\ \theta_{ACC}$ is greater than a predetermined value $\Delta\ \theta_L$ is detected at a step 5311. If $\Delta\ \theta_{ACC} > \Delta\ \theta_L$, it means that the amount of the change $\Delta\ \theta_{ACC}$ is large, i.e., the accelerator pedal has been depressed rapidly, and a flag $F_1$ is made equal to 1 at a step 5312. Then, whether or not the amount of change $\Delta\ \theta_{ACC}$ is greater than a predetermined value $\Delta\ \theta_H$ ($\Delta\ \theta_H > \Delta\ \theta L$) is detected at a step 5313. If $\Delta\ \theta_{ACC} > \Delta\ \theta_H$, an acceleration speed coefficient $K_{ACC}$ is set to be a predetermined value $K_{ACCH}$ at a step 5314. This acceleration speed coeffici $K_{ACC}$ is multiplied to the target throttle valve opening $\theta thref$, and the value obtained by the calculation is set as the control throttle valve opening $\theta out$ at a step 5315. If $\Delta\ \theta_{ACC} \leqq \Delta\ \theta_H$, the acceleration speed coefficient is set to be a predetermined value $K_{ACCL}$ ($K_{ACCH} > K_{ACCL} > 1$) at a step 5316. Subsequently, by the execution of the operation of the step 5315, the acceleration speed coefficient $K_{ACC}$ is multiplied to the target throttle valve opening $\theta thref$, and the value obtained by the calculation is set as the control throttle valve opening $\theta out$.

Figure 8:
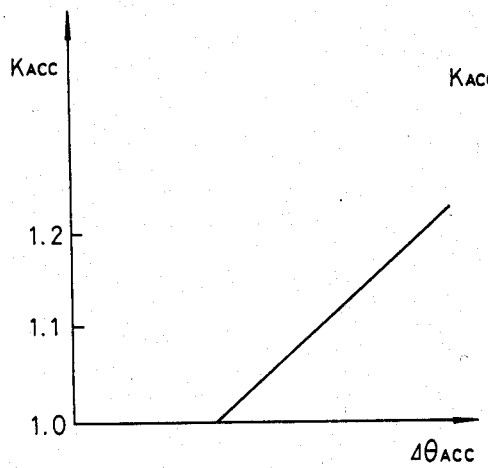
FIG. 8 is a diagram showing the characteristic of a $K_{ACC}$ data map previously stored in the ROM 28.

Furthermore, the operation of the system may be modified such that, instead of the operations of the steps 5313, 5314, and 5316, the relation between the amount of the change $\Delta\ \theta_{ACC}$ in the accelerator peal position and the acceleration speed coefficient $K_{ACC}$ which is shown in FIG. 8 is previously stored in the ROM 28 in the form of a data map, and the acceleration speed coefficient $K_{ACC}$ is searched from the data map. In the above explanation, the acceleration speed coefficient $K_{ACC}$ is multiplied to the target throttle valve opening θthref at the step 5315. However, this step can be replaced by a multiplication of the acceleration speed coefficient $K_{ACC}$ to a throttle valve opening under a condition in which a rapid operation of the accelerator pedal is detected.

On the other hand, if $\Delta\theta_{ACC} \leqq \Delta\theta_L$ at the step 5311, whether or not the flag F1 is equal to 1 is detected at a step 5317. If $F_1=0$, it means that the accelerator pedal was not depressed rapidly, and the control throttle valve opening θout is made equal to the target throttle valve opening θthref at a step 5321. If $F_1=1$ at the step 5317, it means that the operation of the engine is immediately after rapid depression of the accelerator pedal. In this state, a coefficient $K_1$ ($K_1<1$) is multiplied to the acceleration speed coefficient $K_{ACC}$, and the calculated value is set as the new acceleration speed coefficient $K_{ACC}$, at a step 5318. Then, whether or not the acceleration speed coefficient $K_{ACC}$ is smaller than a value of 1.0 is detected at a step 5319. If $K_{ACC} \geqq 1.0$, the control throttle valve opening θout is set by the operation of the step 5315. If $K_{ACC}<1.0$, the flag $F_1$ is made equal to 0 at a step 5320, and the control throttle valve opening θout is set by the operation of the step 5321.

After the setting of the control throttle valve opening θout at the step 5315 or the step 5321, the operations of the steps 56 through 60 are executed in the same manner as in the previous embodiment.

Figure 9:
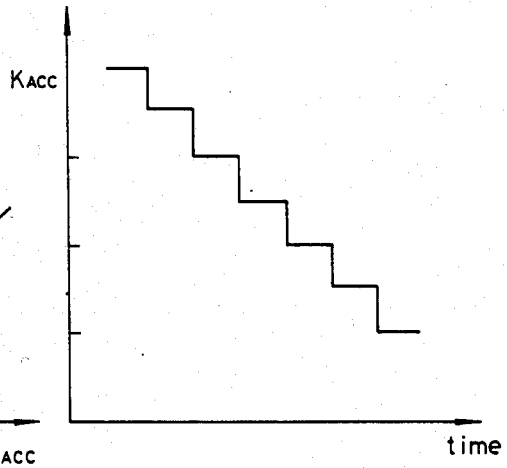
FIG. 9 is a diagram showing the change in the coefficient $K_{ACC}$ immediately after a rapid depression of the accelerator pedal.

In this second embodiment of the throttle valve control system according to the present invention, the acceleration speed coefficient $K_{ACC}$ is determined in accordance with the amount of the change $\Delta\theta_{ACC}$ in the accelerator pedal position if the amount $\Delta\theta_{ACC}$ becomes greater than $\Delta\theta_L$ by the rapid depression of the accelerator pedal 1. Subsequently, by multiplying the coefficient $K_1$ thereto, the acceleration speed coefficient $K_{ACC}$ decreases as the time elapses, in such a manner as shown in FIG. 9. Therefore, the throttle valve opening θth increases rapidly by the rapid depression of the accelerator pedal to the value θthref·$K_{ACCH}$ or the value θthref·$K_{ACCL}$, and subsequently gradually decreases to reach the target throttle valve opening θthref.

As explained above, in the second embodiment of the throttle valve control system for a vehicle mounted internal combustion engine according to the present invention, the throttle valve is driven to an opening corresponding to the rate of change in the operation position of the accelerator pedal when the speed of the change is greater than the predetermined value, and subsequently the throttle valve is gradually driven to the target throttle valve opening for decreasing the difference between the actual throttle valve opening θth and the target throttle valve opening θthref. Therefore, when the accelerator pedal is depressed rapidly, the opening of the throttle valve increases rapidly, to raise the rotational speed of the engine at once. Thus, the acceleration characteristic at the time of the rapid depression of the accelerator pedal is improved.

Figure 10:
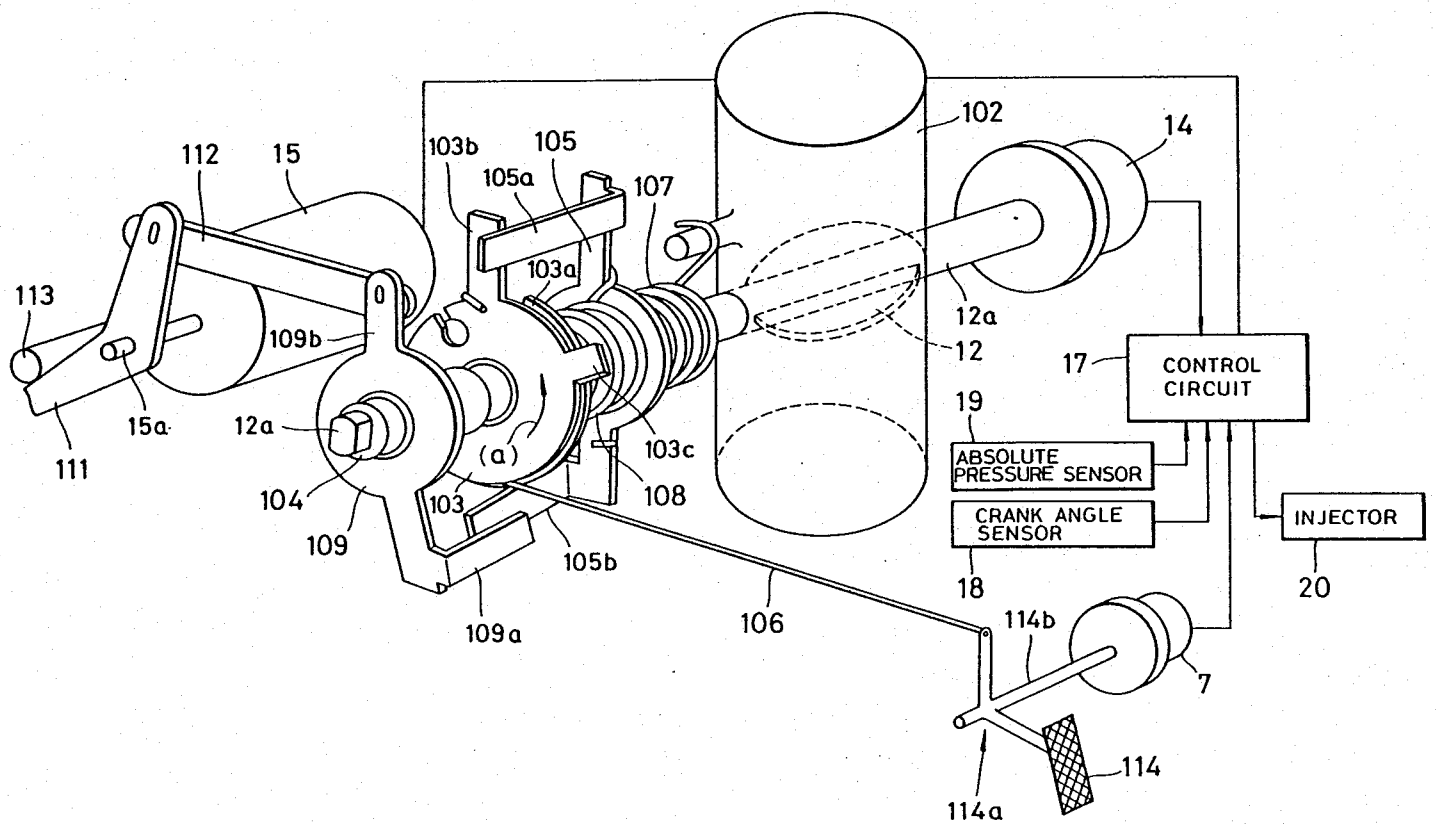
FIG. 10 is a diagram showing the construction of an arrangement for controlling the throttle valve used in a third embodiment of the present invention.
Figure 11:
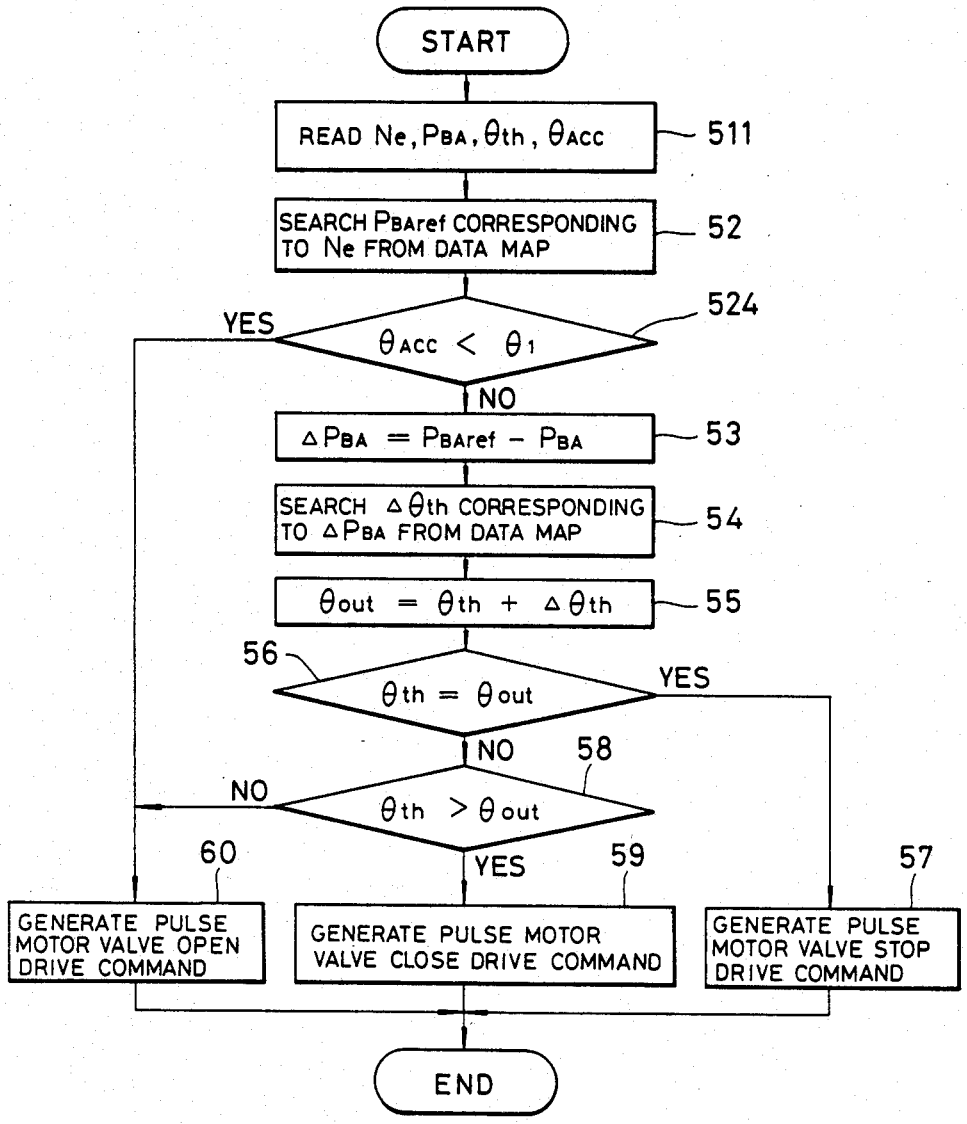
FIG. 11 is a flowchart showing the operation of the CPU 27 in the third embodiment of the present invention.
Figure 12:
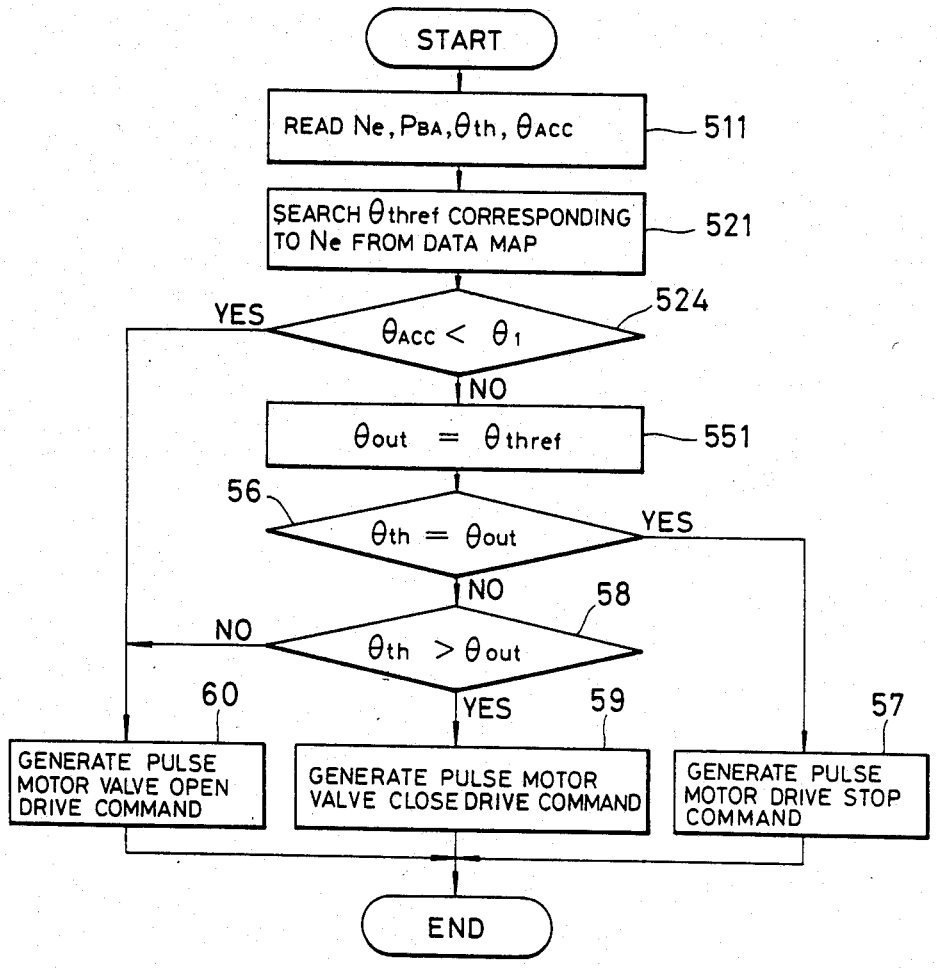
FIG. 12 is a flowchart showing the operation of the CPU 27 in a modification of the third embodiment shown in FIG. 11.

Referring now to FIGS. 10 through 12, the third embodiment of the throttle valve control system according to the present invention will be explained hereinafter.

In the arrangement shown in FIG. 10, the shaft 12a of the throttle valve 12 is extended to the outside of an intake pipe 102 of the engine on opposite side of the throttle valve opening sensor 14. On the extended part of the shaft, a throttle drum 103 is mounted via a free collar 104 inserted into a center hole thereof so that the throttle drum 103 is freely rotatable with respect to the shaft 12a. Also, a throttle direct connection lever 105 is fixed on the shaft 12a. The throttle drum 103 is provided with a wire guide groove 103a formed continuously around its periphery, and a throttle wire 106 having one end connected to the throttle drum 103 is wound around the guide groove 103a. The other end of the throttle wire 106 is connected to a link mechanism 114a of an accelerator pedal 114.

By means of the link mechanism 114a, the throttle wire 106 is pulled toward the accelerator pedal 114 to cause the rotation of the throttle drum 103 in the direction indicated by the arrow (a) in proportion as the accelerator pedal 114 is depressed. Furthermore, the throttle drum 103 is provided with an abutting projection 103b and a forced release projection 103c.

On the other hand, the throttle direct connection lever 105 is provided with an abutting arm 105a and an engaging arm 105b symmetrically about an axis of rotation of the lever 105. The throttle direct connection lever 105 is forced by means of a return spring 107 to rotate in a direction to close the throttle valve 12. The throttle drum 103 and the throttle direct connection lever 105 are forced, by means of a lost motion spring 108 provided between them, to cause an abutment between the abutting projection 103b and the abutting am 105a. With this mechanism, the opening of the throttle valve 12 is varied along with the depression of the accelerator pedal. In addition, on an extremity of the extended part of the shaft 12a, a throttle closing lever 109 is mounted via the free collar 104 so as to rotate freely on the shaft 12a. At an end of the throttle closing lever 109, a stopper arm 109a is provided so that it is contactable with the engaging arm 105b to limit the opening of the throttle valve 12, while the other end of the throttle closing lever 109 is formed as a connection projection 109b. This throttle closing lever 109 is driven by the pulse motor 15.

A rotation shaft 15a of the pulse motor 15 is connected to a central part of a motor lever 111 having a doglegged shape, and an end of the motor lever 111 is connected to the connection projection 109b through a connection rod 112, to cause a rotational motion of the throttle closing lever 109. This end of the motor lever 111 is contactable, by abutment, to a motor stopper 113 to prevent a forward rotation of the pulse motor 15 exceeding a predetermined angle from a reference angular position, and the other end of the motor lever 111 is also contactable, by abutment, to the motor stopper 113 to prevent the rotation of the pulse motor 15 in the reverse direction from the reference angular position.

The accelerator pedal operation position sensor 7 is connected to the link mechanism 114a of the accelerator pedal 114, to produce the output voltage in accordance with the operation position of the accelerator pedal 114, i.e., an accelerator pedal angle which is measured as an angle of rotation of the accelerator pedal about the shaft 114b from the idling position.

On the other hand, the throttle opening sensor 14 is connected to the shaft 12a of the throttle valve 12, to generate the output signal corresponding to the opening of the throttle valve 12.

The accelerator pedal operation position sensor 7, the throttle valve opening sensor 14, and the pulse motor 15 are connected to the control circuit 17 in the same manner as the previous embodiments. Since the construction of the control circuit 17 is identical to that of the circuit explained with reference to FIG. 2, the explanation thereof will not be repeated.

In this embodiment, the CPU 27 operates as a setting means, and the CPU 27, the drive circuit 26a, and the drive mechanism shown in FIG. 10 operate as the drive means.

In the flowchart of FIG. 11, the CPU 27 at first reads the engine rotational speed Ne, the absolute intake manifold pressure $P_{BA}$, the throttle valve opening $\theta$th, and the accelerator pedal angle $\theta_{ACC}$ at predetermined intervals at the step 511. The CPU 27 searches the target absolute intake manifold pressure $P_{BAref}$ from the data map at the step 52. Subsequently, whether or not the read value of the accelerator pedal angle $\theta_{ACC}$ is smaller than a predetermined angle value $\theta_1$ is detected at a step 524. If $\theta_{ACC}<\theta_1$, it means that the state of the system is in a region of a small throttle valve opening, and the program proceeds to the step 60, to generate the pulse motor valve open drive command and to supply it to the drive circuit 26a, in order to establish a throttle valve opening $\theta$th proportional to the accelerator pedal angle $\theta_{ACC}$. On the other hand, if $\theta_{ACC}\geqq\theta_1$, the operation of the system proceeds to the steps 53 through 60 through which the throttle valve 12 is operated in the same manner as the previous embodiments of the present invention. Specifically, whether or not the read value of the throttle valve opening $\theta$th is equal to the control throttle valve opening $\theta$out is detected at a step 56. If $\theta$th$=\theta$out, the pulse motor drive stop command is generated and supplied to the drive circuit 26a at a step 57. If, on the other hand, $\theta$th$\neq\theta$out, whether or not the throttle valve opening $\theta$th is greater than the control throttle valve opening $\theta$out is detected at a step 58. If $\theta$th$>\theta$out, the pulse motor valve close drive command is generated and supplied to the drive circuit 26a at a step 59 so as to limit the throttle valve opening. If $\theta$th$>\theta$out is not satisfied, i.e., if $\theta$th$\leqq\theta$out, the pulse motor valve open drive command is generated and supplied to the drive circuit 26a at a step 60 so as to release the throttle valve 12 in the opening direction.

In response to the pulse motor valve open drive command, the drive circuit 26a drives the pulse motor 15 in the forward direction to rotate the throttle valve closing lever 109 in the direction indicated by the arrow (a). On the other hand, the drive circuit 26a drives the pulse motor 15 in the reverse direction in response to the pulse motor valve close drive command, to rotate the throttle closing lever 109 in a reverse direction with respect to the arrow (a).

When the accelerator pedal 114 is depressed under a condition in which the rotation angle of the pulse motor 15 is in a region of forward rotation from the reference angular position, the throttle wire 106 is pulled toward the accelerator pedal 114, to cause the rotation of the throttle drum 103 in the direction of the arrow (a). By the biasing force of the lost motion spring 108, the throttle direct connection lever 105 also rotates in the direction of the arrow (a) with the abutting arm 105a contacting with the abutting projection 103b. Thus, the throttle valve 12 is moved in the opening direction in proportion to the accelerator pedal angle $\theta_{ACC}$.

Therefore, when the throttle valve opening is in a low opening region in which $\theta_{ACC<\theta 1}$, the pulse motor valve open drive command is generated so that the throttle valve opening $\theta$th becomes equal to an opening proportional to the accelerator pedal opening $\theta_{ACC}$.

If the accelerator pedal 114 is further depressed, the engaging arm 105b of the throttle direct connection lever 105 comes to abut to the stopper arm 109a of the throttle closing lever 109. As a result, the throttle valve 12 stops at the opening under that condition, and the throttle drum 103 rotates in the direction shown by the arrow (a) with the abutting projection 103b being moved away from the abutting arm 105a of the throttle direct connection lever 105.

When the pulse motor 15 is rotated in the reverse direction, the stopper arm 109a comes to abut to the engaging arm 105b due to the reverse rotation of the pulse motor 15 if the throttle valve opening $\theta$th proportional to the accelerator pedal opening $\theta_{ACC}$ has been established. Therefore, the throttle valve 12 is driven in the closing direction irrespectively of the accelerator pedal angle $\theta_{ACC}$.

Also, the rotation of the pulse motor 15 is stopped in response to the pulse motor drive stop command, to maintain the throttle valve opening under that condition. Therefore, the throttle valve opening $\theta$th can be controlled to allow the control throttle valve opening $\theta$out in a region of medium to wide throttle valve opening in which $\theta_{ACC}\geqq\theta_1$.

In the above description, the throttle valve opening is controlled to reduce the difference between the actual absolute intake manifold pressure and the target absolute intake manifold pressure at which the minimum fuel consumption rate is attained and which is determined in accordance with the engine rotational speed in a region of medium to large throttle valve opening in which $\theta_{ACC}>\theta_1$. However, the operation of the system can be modified, as shown by the flowchart of FIG. 12, to use the $\theta$thref data map prepared in the ROM 28 in which values of the target throttle valve opening $\theta$thref at which the minimum fuel consumption rate is attained and which are determined correspondingly to the engine rotational speed are previously stored. As shown, the target throttle valve opening $\theta$thref is searched from the data map at the step 521, and if $\theta_{ACC}\geqq\theta_1$ the step 524, the searched value of the target throttle valve opening $\theta$thref is set as the control throttle valve opening $\theta$out at a step 551. After determining the control throttle valve opening $\theta$out at the step 551 in this way, and if $\theta_{ACC}<\theta_1$ at the step 524, the operations of the steps 56 through 60 are executed in the same manner as the operation explained with reference to FIG. 11.

In the above described third embodiment of the throttle valve control system according to the present invention, the throttle valve is controlled to an opening value which is proportional to the actual operation position of the accelerator pedal when the actual operation position of the accelerator pedal is before a predetermined position. Therefore, the operating state of the engine can be controlled in response to a delicate operation of the accelerator pedal by a driver in the region of small throttle valve opening. Moreover, there is an advantage that the hunting of the throttle valve which might be caused by delay of response of the throttle valve control is prevented, to secure a good driveability of the engine.

Furthermore, in the above explained embodiments of the present invention, the system is constructed such that the drive circuit 26a supplies pulses to the pulse motor 15 at a predetermined rate in accordance with the pulse motor valve open drive command or the pulse motor valve close drive command supplied from the CPU 27. However, it is also possible to adopt an arrangement wherein the pulse motor valve open drive command or the pulse motor valve close drive command generated by the CPU 27 represents the number of pulses corresponding to the difference between the actual throttle valve opening $\theta$th and the control valve opening $\theta$out, and the drive circuit 26*a* supplies the drive pulses of the number determined by these commands from the CPU 27 to the pulse motor 15. Moreover, an ordinary motor can be used in place of the pulse motor used in the above explained embodiments.

In addition, it is to be noted that the throttle valve control system according to the present invention is best suited for use with a device which determines the engine rotational speed in accordance with the operated position of the accelerator pedal such as a CVT (continuously variable transmission) system.

What is claimed is:

1. A throttle valve control system for controlling an opening of a throttle valve disposed in an air induction system of an internal combustion engine, comprising:

engine speed detection means for detecting a rotational speed of said internal combustion engine;

pressure detection means for detecting an actual pressure in an intake pipe of said air induction system, downstream of said throttle valve;

throttle valve opening detection means for detecting an actual throttle valve opening of said throttle valve;

first setting means for setting a target throttle valve opening to attain a minimum fuel consumption rate of said internal combustion engine, in accordance with said rotational speed detected by said engine speed detection means;

second setting means for setting a target pressure in the intake pipe to attain the minimum fuel consumption rate of said internal combustion engine, in accordance with said rotational speed detected by said engine speed detection means; and drive means, for driving said throttle valve to an opening value selected to reduce a difference between said actual pressure in the intake pipe detected by said pressure detection means and said target pressure in the intake pipe set by said second setting means when said actual throttle opening detected by said throttle valve opening detection means is in an allowable range determined about said target throttle valve opening, and for driving said throttle valve to an opening value selected to reduce a difference between said actual throttle valve opening and said target throttle valve opening when said actual throttle valve opening is not in said allowable range.

2. A throttle valve control system for controlling the opening of a throttle valve disposed in an air induction system of an internal combustion engine mounted on a vehicle, comprising:

accelerator pedal operation position detection means for detecting an operation position of an accelerator pedal of said vehicle and producing an accelerator pedal operation position signal;

change rate detection means for detecting a rate of change in said operation position of said accelerator pedal by means of said accelerator pedal operation position signal;

engine speed detection means for detecting a rotational speed of said internal combustion engine;

throttle valve opening detection means for detecting an actual opening of said throttle valve;

setting means for setting a target throttle valve opening to attain a minimum fuel consumption rate of said internal combustion engine, in accordance with said rotational speed detected by said engine speed detection means; and drive means for driving said throttle valve to an opening selected to reduce a difference between said actual throttle valve opening detected by said throttle valve opening detection means and said target throttle valve opening set by said setting means, wherein said drive means is adapted to drive said throttle valve to an opening corresponding to a rate of change in said accelerator pedal operation position when said rate of change in said accelerator pedal operation position detected by said change rate detection means exceeds a predetermined value.

3. A throttle valve control system as set forth in claim 2, wherein said drive means is adapted to drive said throttle valve gradually to said opening selected to reduce a difference between said actual throttle valve opening detected by said throttle valve opening detection means and said target throttle valve opening set by said setting means when said rate of change in the accelerator pedal operation position detected by said change rate detection means has decreased to be smaller than said predetermined value from a value greater than said predetermined value.

4. A throttle valve control system for controlling the opening of a throttle valve disposed in an air induction system of an internal combustion engine mounted on vehicle, comprising:

accelerator pedal operation position detection means for detecting an operation position of an accelerator pedal of said vehicle;

engine speed detection means for detecting a rotational speed of said internal combustion engine;

engine parameter detection means for detecting a predetermined operational parameter of said internal combustion engine other than said speed of said internal combustion engine;

setting means for setting a target value of said predetermined engine parameter to attain a minimum fuel consumption characteristic of said internal combustion engine in accordance with said rotational speed detected by said engine speed detection means; and drive means for driving said throttle valve to an opening proportional to said actual operation position of said accelerator pedal when said actual operation position of said accelerator pedal detected by said accelerator pedal operation position detection means is before a predetermined position, and for driving said throttle valve to an opening selected to reduce a difference between a detected value of said engine parameter detected by said engine parameter detection means and said target value set by said setting means when said actual operation position is beyond said predetermined position.

5. A throttle valve control system as set forth in claim 4, wherein said engine parameter detection means detects a pressure in an intake pipe of said internal combustion engine, downstream of said throttle valve as said predetermined engine parameter.

6. A throttle valve control system as set forth in claim 4, wherein said engine parameter detection means detects said opening of said throttle valve as said predetermined engine parameter.

* * * * *